US009795530B2

(12) United States Patent
Jordan et al.

(10) Patent No.: US 9,795,530 B2
(45) **Date of Patent: *Oct. 24, 2017**

(54) INDEPENDENTLY ADJUSTING MULTI-LEGGED MODULAR WALKER/CANE ASSEMBLY

(71) Applicant: RANjAM LLC, Grapevine, TX (US)

(72) Inventors: James Dale Jordan, Grapevine, TX (US); Shyh Min Chen, Plano, TX (US)

(73) Assignee: RANjAM LLC, Grapevine, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/959,932

(22) Filed: Dec. 4, 2015

(65) Prior Publication Data

US 2016/0081443 A1 Mar. 24, 2016

Related U.S. Application Data

(63) Continuation-in-part of application No. 14/188,282, filed on Feb. 24, 2014, now Pat. No. 9,233,047.

(Continued)

(51) Int. Cl.

| | |
|---|---|
| ***A61H 3/04*** | (2006.01) |
| ***A61H 3/00*** | (2006.01) |
| ***A45B 7/00*** | (2006.01) |
| ***A45B 9/04*** | (2006.01) |
| ***A61H 3/02*** | (2006.01) |

(52) U.S. Cl.

CPC ..... *A61H 3/00* (2013.01); *A45B 7/00* (2013.01); *A45B 9/04* (2013.01); *A61H 3/0277* (2013.01);

(Continued)

(58) Field of Classification Search

CPC ... A61H 3/00; A61H 3/02; A61H 3/04; A61H 2201/0161; A61H 2201/1676; A61H 2003/0272; A61H 2003/0205; A61H 2003/025; A61H 3/0277; A45B 3/00; A45B 9/04; A45B 2009/007

(Continued)

(56) References Cited

U.S. PATENT DOCUMENTS 2,856,943 A * 10/1958 Sparlin ..... A61H 3/0277 135/68

3,455,313 A 7/1969 King (Continued)

FOREIGN PATENT DOCUMENTS

JP 2008220642 A 9/2008

*Primary Examiner* — Winnie Yip

(74) *Attorney, Agent, or Firm* — Kirby B. Drake; Klemchuk LLP

(57) ABSTRACT

A walker/cane assembly, multi-legged cane, and single-pointed cane may share common parts that may be easily connected and detached to allow a user to convert a walker/cane assembly to a multi-legged cane and/or a single-pointed cane. Accordingly, a user may use a single assembly that may be quickly and easily modified to meet the user's needs, such as his/her current balance or energy level. One or more folding mechanisms may be employed to allow the walker/cane assembly, or the frame forming a portion of the walker/cane assembly, to be easily collapsed and folded. This may allow a user to store the walker/cane assembly, or the frame portion of the assembly, in a smaller amount of space than the expanded walker/cane assembly or the frame portion of the assembly may otherwise occupy.

19 Claims, 14 Drawing Sheets

Related U.S. Application Data

(60) Provisional application No. 61/769,351, filed on Feb. 26, 2013.

(52) U.S. Cl.
CPC ..... *A61H 3/04* (2013.01); *A61H 2003/0272* (2013.01); *A61H 2201/0107* (2013.01); *A61H 2201/0161* (2013.01); *A61H 2201/0192* (2013.01); *A61H 2201/1635* (2013.01); *Y10T 29/49716* (2015.01)

(58) Field of Classification Search
USPC ..... 135/65–69, 70, 74, 77–78, 82, 858, 85; 482/65–69, 75; 280/87.021, 87.041; 297/5; 29/428
See application file for complete search history.

(56) References Cited

U.S. PATENT DOCUMENTS 3,692,359 A * 9/1972 Boucher ..... A47D 1/08 280/30
4,748,994 A 6/1988 Schultz et al.
4,995,412 A 2/1991 Hirn et al.
5,785,070 A * 7/1998 Block ..... A45B 9/00 135/65
5,816,593 A 10/1998 Che
6,003,532 A 12/1999 Pi
6,055,998 A 5/2000 Bader
6,070,603 A 6/2000 Politz
7,021,324 B1 4/2006 Clay et al.
7,494,138 B2 2/2009 Graham
8,607,809 B2 12/2013 Jordan et al.
2003/0137119 A1* 7/2003 Razon ..... A61H 3/008 280/87.021
2010/0051076 A1* 3/2010 McGann ..... A61H 3/00 135/67
2011/0315177 A1 12/2011 McGann et al.
2013/0168931 A1* 7/2013 Baraitaru ..... A61H 3/04 280/30
2013/0319488 A1 12/2013 Chiu
2015/0328079 A1* 11/2015 Liles ..... A61G 7/1038 280/47.34

* cited by examiner

INDEPENDENTLY ADJUSTING MULTI-LEGGED MODULAR WALKER/CANE ASSEMBLY

CROSS-REFERENCE TO RELATED APPLICATIONS

This application claims the benefit of U.S. patent application Ser. No. 14/188,282, entitled "Independently Adjusting Multi-Legged Modular Walker/Cane Assembly," filed Feb. 24, 2014, and U.S. Provisional Application No. 61/769,351, entitled "Independently Adjusting Multi-Legged Modular Walker/Cane," filed Feb. 26, 2013, both of which are incorporated herein by reference in their entirety.

FIELD OF THE DISCLOSURE

The present disclosure generally relates to walkers and canes, and more particularly to independently adjusting multi-legged modular walker/cane assemblies.

BACKGROUND

Persons who need assistance in maintaining stability while walking often use walking canes and walkers. There may be times when a person needs to use a walking cane and other times may need to use a walker, sometimes within a short period of time, depending on the functionality needed or the circumstances in which the walker or walking cane may be used. For example, there are about 1 million hip and knee replacement surgeries performed each year in the United States. Most of those undergoing these types of surgeries will use a walker for 10 days to 2 weeks and then transition to a cane.

SUMMARY

Embodiments of the present disclosure may provide a walker/cane assembly comprising a frame having a plurality of independently adjustable and selectively detachable legs, each of the plurality of independently adjustable and selectively detachable legs having a tube section, a spring or tension element within the tube section between a plunger at a lower end of the tube section and an end stop at an upper end of the tube section, and a foot extending from a lower portion of the tube section, the foot having a roller, wherein as downward pressure is applied to the walker/cane assembly, the foot on the end of each leg may compress the spring or tension element within each leg, allowing the roller on foot to stay in constant contact with the ground, wherein at least one of the plurality of independently adjustable and selectively detachable legs is a multiple leg structure having a single base, a pair of single-pointed canes attached to the frame via one or more quick disconnects, wherein, using the plurality of independently adjustable and selectively detachable legs and at least one of the pair of single-pointed canes of the walker/cane assembly, the walker/cane assembly may be selectively convertible from a walker to a multilegged cane to a single-pointed cane, and an interchangeable base that may receive one of the pair of single-pointed canes and at least one of the plurality of independently adjustable and selectively detachable legs detached from the walker/cane assembly, thereby transforming the walker/cane assembly into a multi-legged cane. The walker/cane assembly also may include a folding mechanism on the frame to selectively expand and collapse the walker/cane assembly when not in use. The walker/cane assembly may be converted from a walker to a single-pointed cane through release of the one or more quick disconnects. At least two of the plurality of independently adjustable and selectively detachable legs may include openings on an upper end to receive at least a portion of the pair of single-pointed canes. The pair of single-pointed canes may provide quick height adjustment functionality. The pair of single-pointed canes may lock into place within the openings via detents. The plurality of independently adjustable and selectively detachable legs may be comprised of three independently adjustable and tensioned legs positioned in a triangular arrangement wherein a first leg forms the central support for the frame and the second leg and the third leg are positioned at approximately 45-degree angles relative to the first leg. The second leg and the third leg may extend from a vertical portion of the frame located above the first leg via horizontal extender portions. The horizontal extender portions may remain positioned at 45-degree angles relative to the vertical portion when the frame is in an extended state. The first leg may be integrally formed with the vertical portion. The first leg may be detachably connected to the vertical portion. At least one of the horizontal extender portions may include the one or more quick disconnects to selectively receive one of the pair of single-pointed canes. The walker/cane assembly also may include an extended foot support, wherein the extended foot support may act as a stabilizer to maintain the walker/cane assembly in an upright position.

Other embodiments of the present disclosure may provide a walker/cane assembly comprising a frame having a plurality of independently adjustable and selectively detachable legs, each of the plurality of independently adjustable and selectively detachable legs having a tube section with a slot, a spring or tension element within the tube section between a lower end of the tube section and an end stop at an upper end of the tube section, and a foot extending from a lower portion of the tube section, wherein as downward pressure is applied to the walker/cane assembly, the foot on the end of each leg may compress the spring or tension element within each leg, wherein at least one of the plurality of independently adjustable and selectively detachable legs is a multiple leg structure having a single base, a pair of single-pointed canes attached to the frame via one or more quick disconnects, wherein, using the plurality of independently adjustable and selectively detachable legs and at least one of the pair of single-pointed canes of the walker/cane assembly, the walker/cane assembly may be selectively convertible from a walker to a multilegged cane to a single-pointed cane, and an interchangeable base that may receive one of the pair of single-pointed canes and at least one of the plurality of independently adjustable and selectively detachable legs detached from the walker/cane assembly, thereby transforming the walker/cane assembly into a multi-legged cane. The end stop may push against a detent button to maintain the spring or tension element in position. The slot in the tube section may allow the detent button to latch the tube section. The walker/cane assembly may further include a quick disconnect shock absorbing leg attached to the frame. The quick disconnect shock absorbing leg may be connected to one of the pair of single-pointed canes to convert to a spring-loaded shock absorbing cane. The quick disconnect shock absorbing leg may be attached using an adaptor, wherein an upper end of the adaptor may be attached to the frame and a bottom end of the adaptor may contain a detent button to receive the quick disconnect shock absorbing leg.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide an independently adjusting multi-legged modular walker/cane assembly that may be selectively converted from a walker/cane assembly into one or more multi-legged canes or to one or more single-pointed canes. As parts are shared among the walker/cane assembly, the multi-legged cane and the single-pointed cane, a user of a walker/cane assembly according to embodiments of the present disclosure may easily convert the assembly from a walker to canes of different varieties and vice versa in a fast and flexible manner to address changing needs.

Figure 1:
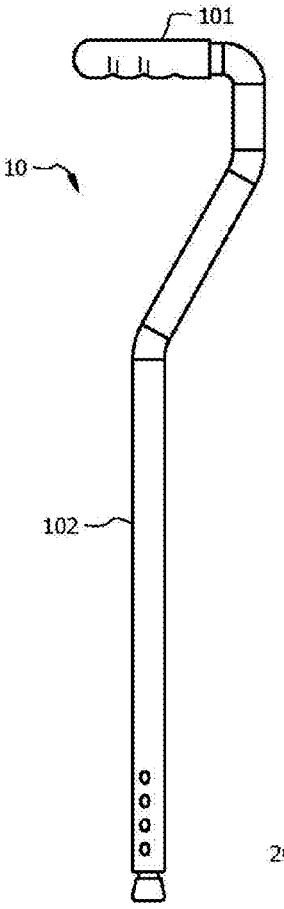
FIG. 1 depicts a single-pointed cane that may be used to form a vertical portion of a walker/cane assembly according to an embodiment of the present disclosure.
Figure 3:
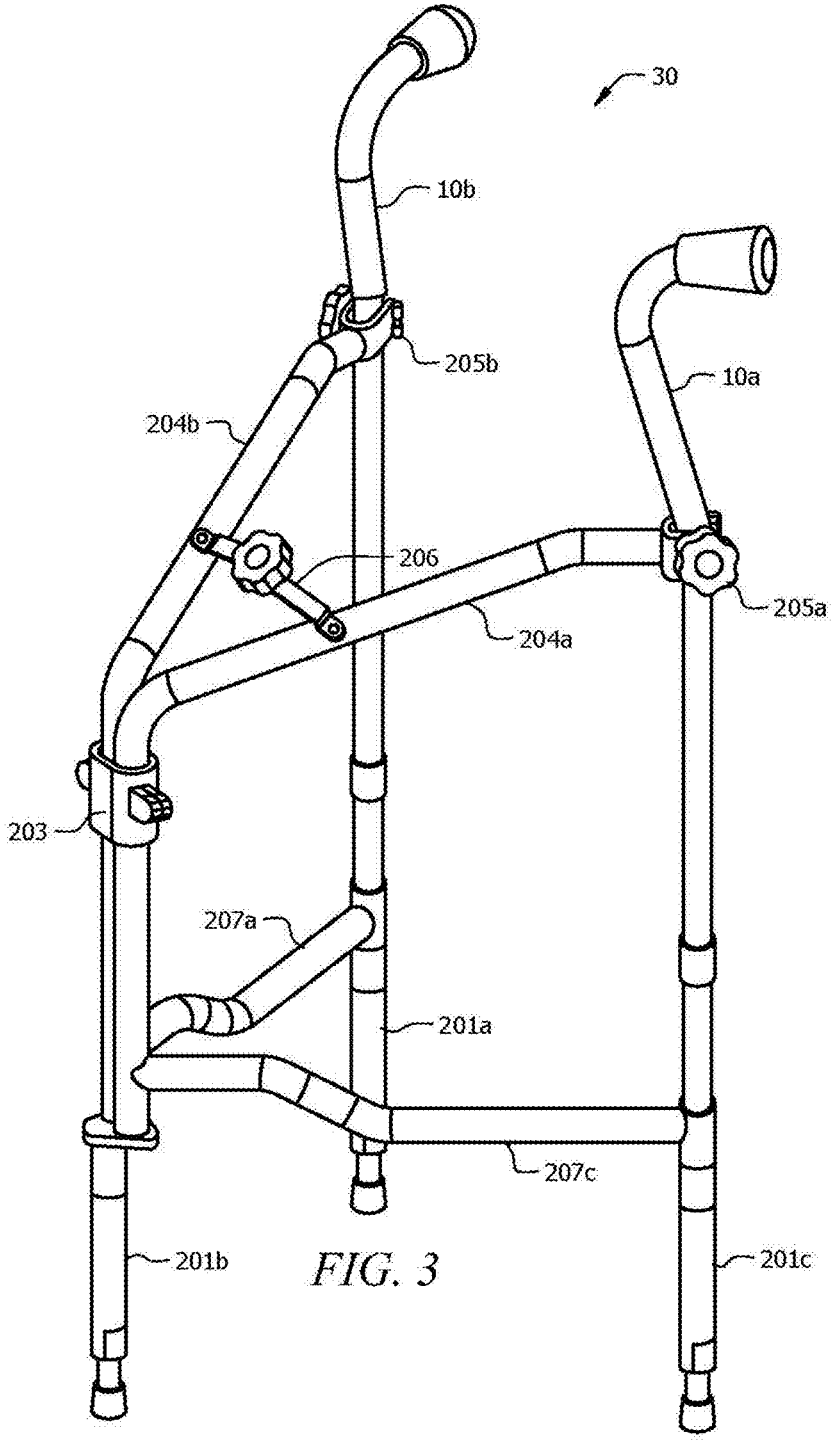
FIG. 3 depicts a walker/cane assembly formed by connecting two single-pointed canes as depicted in FIG. 1 with a multi-legged frame as depicted in FIG. 2 according to an embodiment of the present disclosure.

FIG. 1 depicts single-pointed cane 10 that may be used to form one of two vertical support portions (10*a*, 10*b*) of walker/cane assembly 30 as depicted in FIG. 3 according to an embodiment of the present disclosure. Single-pointed cane 10 may include handle or grip element 101 and shaft 102 having an upper end receiving handle or grip element 101 and a lower end. It should be appreciated that there may be embodiments of the present disclosure wherein shaft 102 is rigid; however, there may be other embodiments wherein shaft 102 may include a spring or tension element as described in FIG. 7 with respect to a leg.

Figure 2:
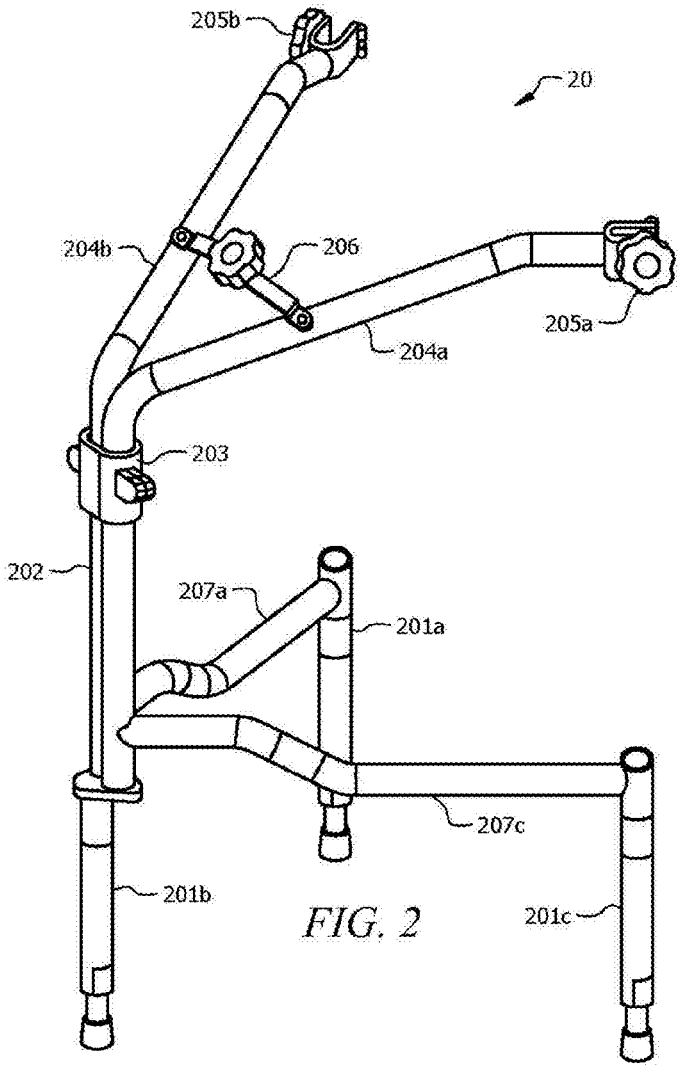
FIG. 2 depicts a multi-legged frame that may be used to form a center portion of a walker/cane assembly according to an embodiment of the present disclosure.

FIG. 2 depicts multi-legged frame 20 that may be used to form a central support portion of walker/cane assembly 30 as depicted in FIG. 3 according to an embodiment of the present disclosure. Multi-legged frame 20 may include a plurality of legs (201*a*, 201*b*, 201*c*) that may stabilize frame 20. In an embodiment of the present disclosure, legs 201*a*, 201*b*, 201*c* may be positioned in a triangular arrangement wherein leg 201*b* may form a central support for frame 20 when frame 20 is expanded and legs 201*a*, 201*c* may each be placed at approximately 45-degree angles relative to leg 201*b*. Legs 201*a*, 201*c* may extend from vertical portion 202 via horizontal extender portions 207*a*, 207*c* according to an embodiment of the present disclosure. Horizontal extender portions 207*a*, 207*c* may be rigid such that they remain at 45-degree angles relative to vertical portion 202 in embodiments of the present disclosures. However, it should be appreciated that there may be embodiments of the present disclosure wherein horizontal extender portions 207*a*, 207*c* may have flexibility to be moved and locked into position relative to vertical portion 202 without departing from the present disclosure.

Leg 201*b* may be integrally formed with vertical portion 202 of frame 20 according to an embodiment of the present disclosure. However, it should be appreciated that there may be other embodiments of the present disclosure wherein leg 201*b* may be releasably and/or detachably connected to vertical portion 202. Vertical portion 202 may include adjustment mechanism 203 that may permit a user to selectively raise or lower the height of frame 20 according to embodiments of the present disclosure. Adjustment mechanism 203 may include but is not limited to a screw, a nut, and a release/lock button.

Vertical portion 202 may be formed from a pair of cane receiving supports 204*a*, 204*b* that may be placed in parallel with one another up to a point above adjustment mechanism 203 wherein cane receiving supports 204*a*, 204*b* diverge and are separated at a comfortable distance for a user to hold canes 10*a*, 10*b* when frame 20 is in an expanded position.

While each of the legs is depicted as a single leg, it should be appreciated that there may be embodiments of the present disclosure wherein one or more of the single legs may be substituted with a base having a plurality of legs.

Figure 4:
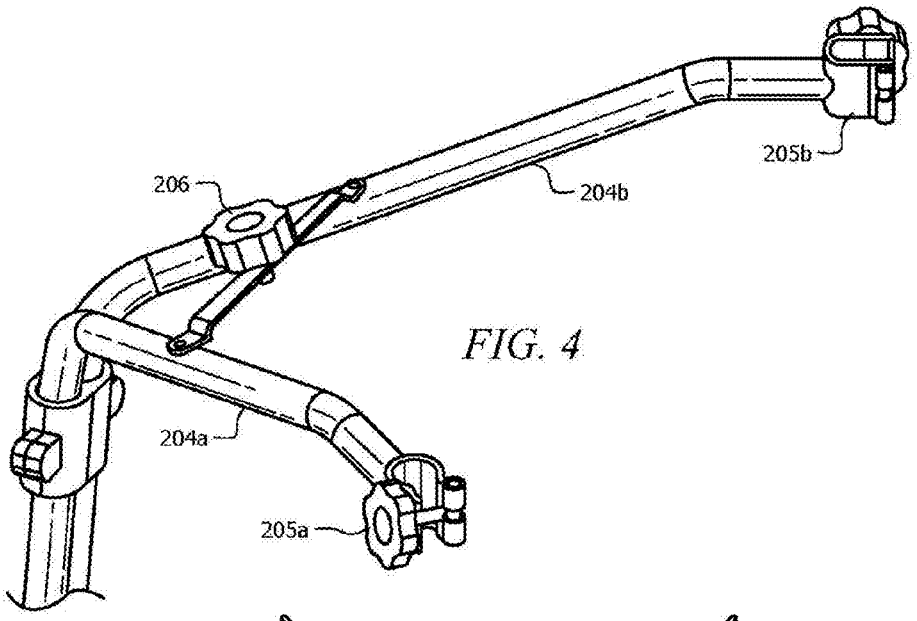
FIG. 4 depicts how single-pointed canes as depicted in FIG. 1 may be attached to a multi-legged frame as depicted in FIG. 2 via one or more quick disconnects according to an embodiment of the present disclosure.

As depicted in FIG. 4, cane receiving supports 204*a*, 204*b* may include quick disconnects 205*a*, 205*b* secured to selectively receive canes 10*a*, 10*b* according to an embodiment of the present disclosure. It should be appreciated that quick disconnects 205*a*, 205*b* may be permanently affixed to cane receiving supports 204*a*, 204*b* in an embodiment of the present disclosure. However, it should be appreciated that quick disconnects 205*a*, 205*b* may be selectively and removably detachable from cane receiving supports 204*a*, 204*b* without departing from the present disclosure.

In some embodiments of the present disclosure, horizontal extender portions 207*a*, 207*c* may each include quick disconnects at the ends opposite vertical support 202. Horizontal extender portions 207*a*, 207*c* may receive single-pointed canes 10*a*, 10*b* and lock into place, and in such embodiments, legs 201*a*, 201*c* may not be present as part of frame 20. In these embodiments of the present disclosure, single-pointed canes 10*a*, 10*b* may be locked into place relative to horizontal extender portions 207*a*, 207*c* via a detent or similar fastening mechanism as described in more detail with respect to FIG. 3.

FIG. 3 depicts walker/cane assembly 30 that may be formed by selectively and releasably attaching single-pointed canes 10*a*, 10*b* to multi-legged frame 20 via quick disconnects 205*a*, 205*b* according to an embodiment of the present disclosure. In this embodiment of the present disclosure, legs 201*a*, 201*c* may include openings on their upper ends to receive single-pointed canes 10*a*, 10*b* respectively, and single-pointed canes 10*a*, 10*b* may be locked into place within legs 201*a*, 201*c* via a detent. However, it should be appreciated that other locking/fastening mechanisms may be used without departing from the present disclosure.

Figure 5:
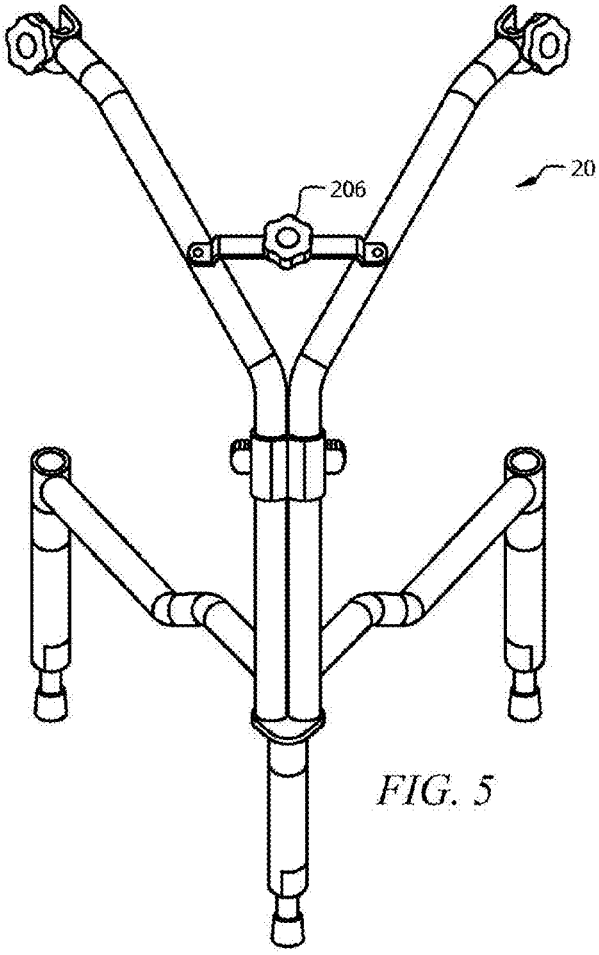
FIG. 5 depicts a folding mechanism that may be employed to fold a walker/cane assembly according to an embodiment of the present disclosure.

Frame 20 also may include folding mechanism 206 that may be employed to selectively expand and lock into place receiving supports 204*a*, 204*b* when frame 20 is to be used. More specifically, FIG. 5 depicts a front view of folding mechanism 206 in an expanded or open position that may be employed to fold frame 20, such as for transport or storage, according to an embodiment of the present disclosure. Folding mechanism 206 may operate similar to a hinge or bracket that may be used to open and close a folding table. When folding mechanism 206 collapses, frame 20 or the walker/cane assembly as a whole may be easily placed in the back seat or in the trunk of a car. Similarly, a user may fold the walker/cane assembly and place it next to his/her table if dining in a restaurant.

Figure 6:
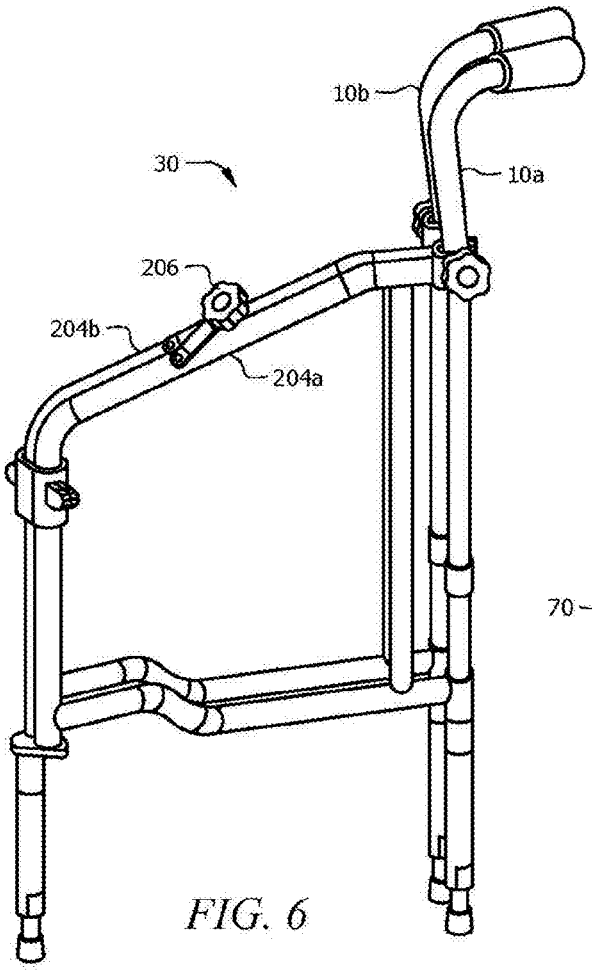
FIG. 6 depicts a folded walker/cane assembly according to an embodiment of the present disclosure.

FIG. 6 depicts walker/cane assembly 30 when in a folded or closed position according to an embodiment of the present disclosure. In the folded position, folding mechanism 206 may fold and secure cane receiving supports 204*a*, 204*b* in a parallel position relative to one another. Similarly, horizontal extended portions 207*a*, 207*c* may be secured in a parallel position relative to one another when assembly 30 is in a folded position according to an embodiment of the present disclosure. It should be appreciated that a second folding mechanism may be employed with respect to horizontal extender portions 207*a*, 207*c* without departing from the present disclosure.

In the embodiment depicted in FIG. 6, single-pointed canes 10*a*, 10*b* remain attached to frame 20 via quick disconnects 205*a*, 205*b* even in the folded position. This may allow for easier temporary storage of walker/cane assembly 30, for example, when a user of assembly 30 is dining at a restaurant and will need to continue use of assembly 30 following the meal. However, it should be appreciated that single-pointed canes 10*a*, 10*b* may be detached from frame 20 prior to folding without departing from the present disclosure.

Figure 7:
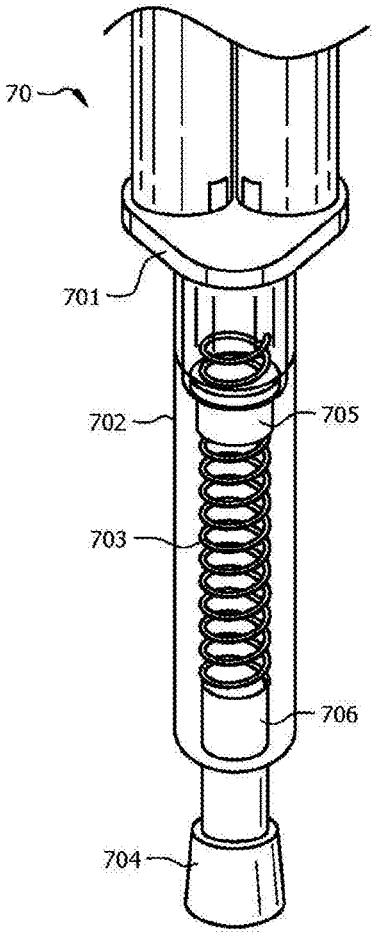
FIG. 7 depicts one of a plurality of legs on a walker/cane assembly according an embodiment of the present disclosure.

FIG. 7 depicts one of a plurality of legs on a walker/cane assembly according an embodiment of the present disclosure. As shown in FIG. 7, each leg, such as leg 70 may include base 701, tube section 702 extending downwardly from base 701, spring or tension element 703, and foot 704 extending from the lower portion of tube section 702 to provide solid contact with the walking surface when the walker/cane assembly is in use. Spring or tension element 703 may be positioned within tube section 702 between plunger 706 at a lower end of tube section 702 and end stop 705 at an upper end of tube section 702. Spring or tension element 703 may compress under load and then may extend as the load is reduced according to embodiments of the present disclosure. The position of end stop 705 may be adjustable through use of detents, thereby allowing the user to adjust for his/her preferences or needs. Foot 704 may have a tipped bottom that may act as a foot for leg 70 to grip the ground surface when the walker/cane assembly, multi-legged cane, or single-pointed cane having such a leg is in use.

Positive constant contact may be attained by allowing leg 70 to adjust to variations in the position of foot 704 of leg 70 relative to the angle of the walker/cane assembly as a whole, taking into account surface variations, and the walking position of the user. As downward pressure is applied to the walker/cane assembly, the foot on the end of each leg of the assembly may compress the spring or tension element within each leg, thereby allowing the foot to stay in constant contact with the ground or surface, regardless of the angle of the walker/cane assembly, while each leg of the assembly may maintain the same up and down travel distance capability. It should be appreciated that spring tension within each leg may be adjusted to compensate for different-sized users via detents in the foot housing and/or with interchange of springs.

Figure 16:
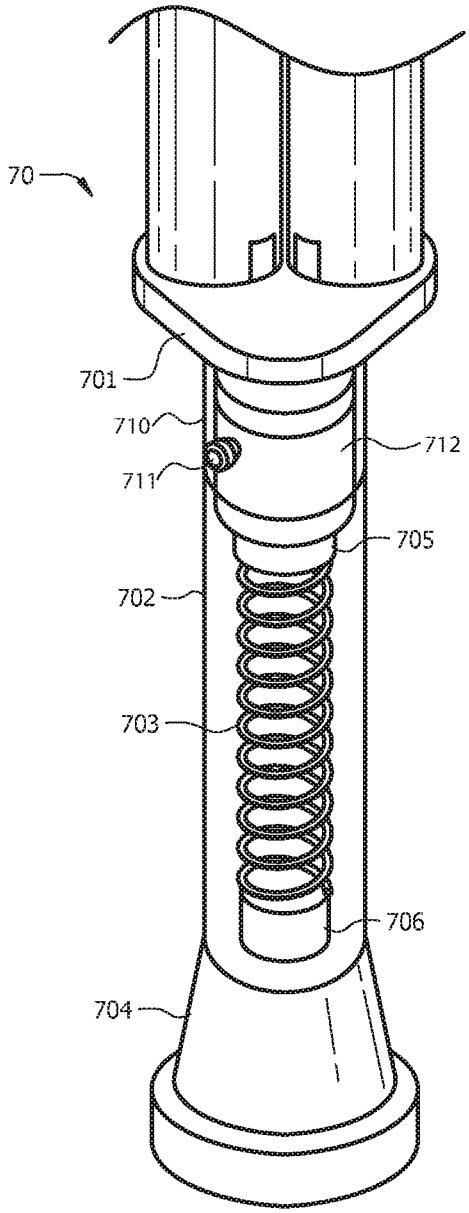
FIG. 16 depicts the one of a plurality of legs on a walker/cane assembly of FIG. 7 modified to eliminate the plunger according to an embodiment of the present disclosure.

It should be appreciated that there may be other embodiments of the present disclosure wherein one of a plurality of legs on a walker/cane assembly as depicted in FIG. 7 may be constructed without use of a plunger, such as that which is depicted in FIG. 16. In such embodiments, end stop 705 may push against detent button 711 to maintain spring or tension element 703 in position. Tube section 702 may include slot 710 to allow the detent button 711 to latch tube section 702. It should be appreciated that adaptor 712 (as described below) may allow the leg to be attached to/detached from the frame. More specifically, by depressing detent button 711 on adaptor 712, the new leg may be attached to or detachedfrom the frame and adaptor 712 according to an embodiment of the present disclosure. When this quick disconnect leg is connected to a single-pointed cane, the single-pointed cane may be converted to a spring-loaded shock absorbing cane. Accordingly, a walker/cane assembly according to embodiments from the present disclosure may selectively convert into a multi-legged spring-loaded shock absorbing cane as well as to a single-pointed spring-loaded shock absorbing cane.

It should be appreciated that the quick disconnect shock absorbing leg may be attached to the walker/cane assembly using an adaptor according to an embodiment of the present disclosure. An upper end of the adaptor may attached to the frame of the walker/cane assembly, and a bottom end of the adaptor may contain a detent button to receive the quick disconnect shock absorbing leg according to an embodiment of the present disclosure. The adaptor may be attached to the frame of the walker/cane assembly, and the end stop may push against the detent button on the adaptor according to embodiments of the present disclosure.

Figure 8:
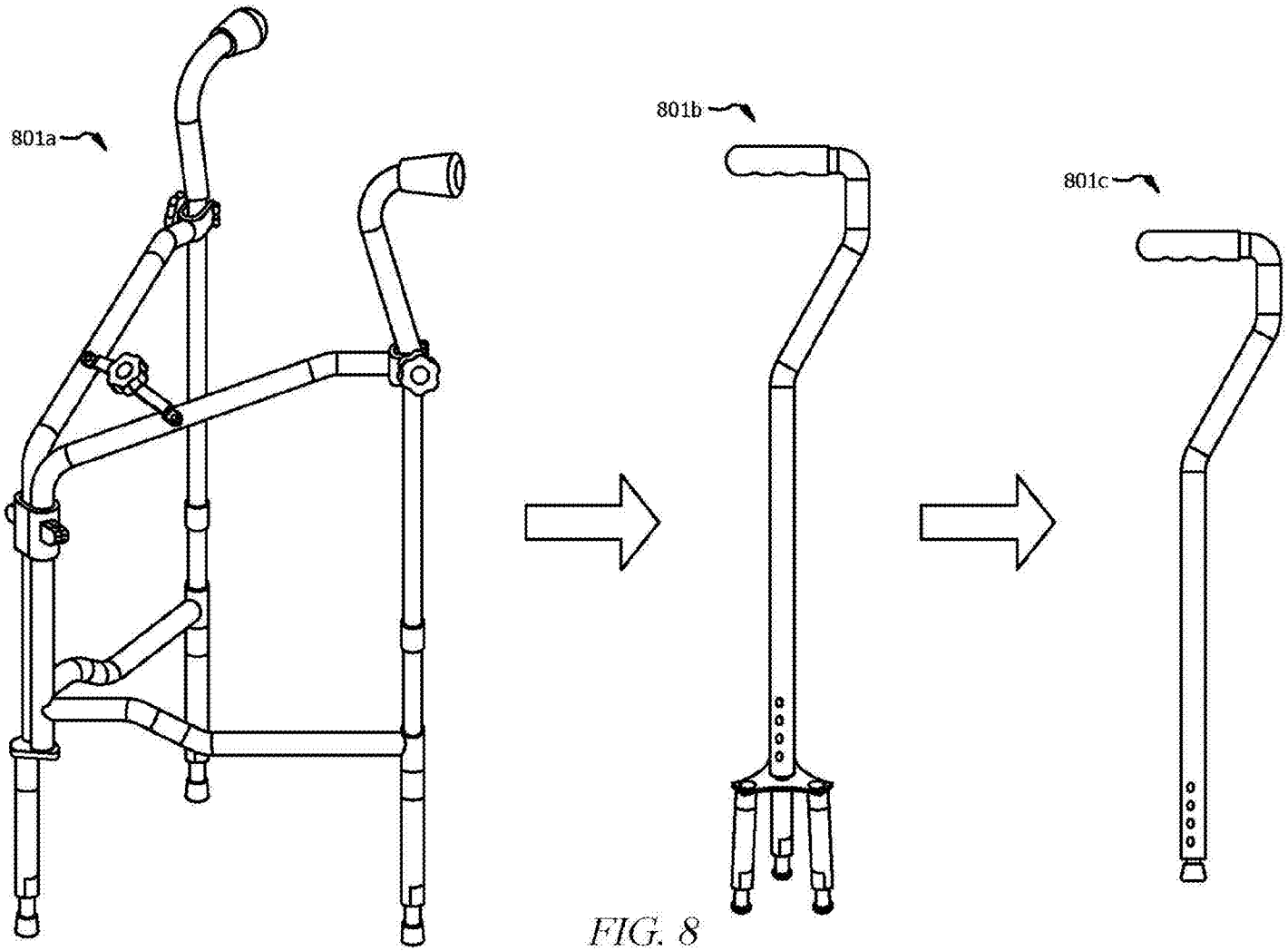
FIG. 8 depicts a walker/cane assembly when assembled as a walker, as a multi-legged cane, and as a single-pointed cane according to an embodiment of the present disclosure.

FIG. 8 depicts the convertibility of a walker/cane assembly according to an embodiment of the present disclosure. Item 801*a* depicts a walker/cane assembly when fully assembled according to an embodiment of the present disclosure. A user may convert the walker/cane assembly into a multi-legged cane (801*b*) by detaching the plurality of legs from walker/cane assembly and securing/affixing one or more of the plurality of independently adjustable and tensioned legs to an interchangeable base. A user may then convert the walker/cane assembly (801*a*) into a single-pointed cane (801*c*) by detaching the single-pointed cane from the walker/cane assembly through release of a quick disconnect. The single-pointed cane also may be detached by detaching a fastening mechanism, such as a nut, that may connect the cane to a multi-legged frame. A detent button also may be depressed to detach the single-pointed cane from the frame according to embodiments of the present disclosure. A user may convert the multi-legged cane (801*b*) to a single-pointed cane (801*c*) by removing the single-pointed cane from the base of a multi-legged cane according to embodiments of the present disclosure. Although only one single-pointed cane is depicted in FIG. 8, it should be appreciated that a walker/cane assembly may be converted into two single-pointed canes according to embodiments of the present disclosure. The convertibility of a walker/cane assembly according to embodiments of the present disclosure may facilitate the rehabilitation process of a user so that the user may use a single assembly to advance from a walker to a multi-legged cane to a single-pointed cane.

Figure 13:
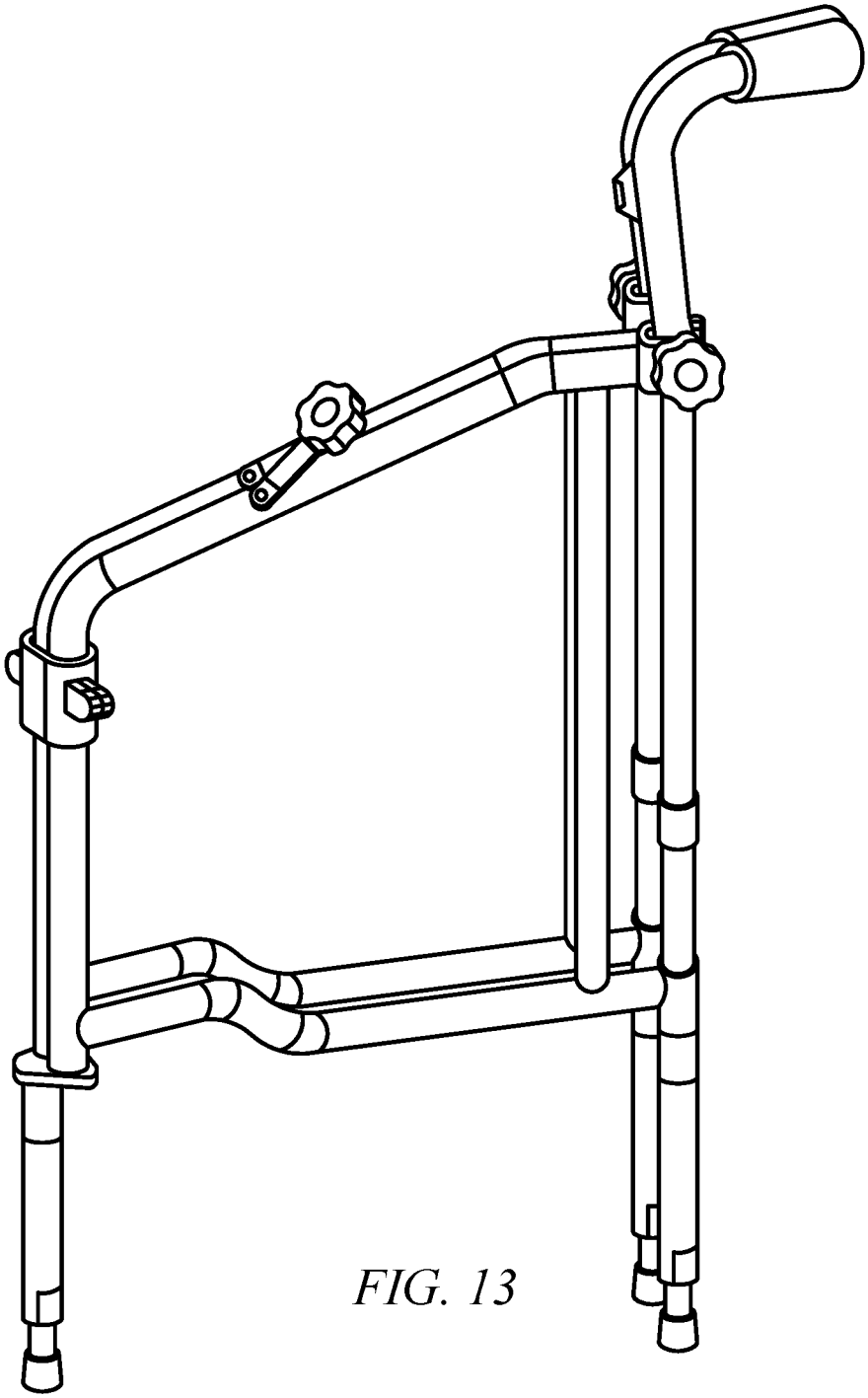
FIG. 13 depicts a walker/cane assembly having a pair of single-pointed canes containing a quick height adjustment functionality according to an embodiment of the present disclosure.

In other embodiments of the present disclosure, the pair of single-pointed canes may be quick height adjustment canes, such as depicted in FIG. 13. The quick height adjustment functionality, such as provided through the trigger, may provide an ergonomically designed patient assistive device that may serve as a walker but also support a patient to stand from a seated position. In addition, this quick height adjustment functionality may aids users to rise from seated positions in virtually any environment including, but not limited to, sofas, beds, soft chairs and toilets. While the trigger in FIG. 13 is depicted in a location on the walker/cane assembly, it should be appreciated that the trigger may be located in other positions without departing from the present disclosure.

Figure 9:
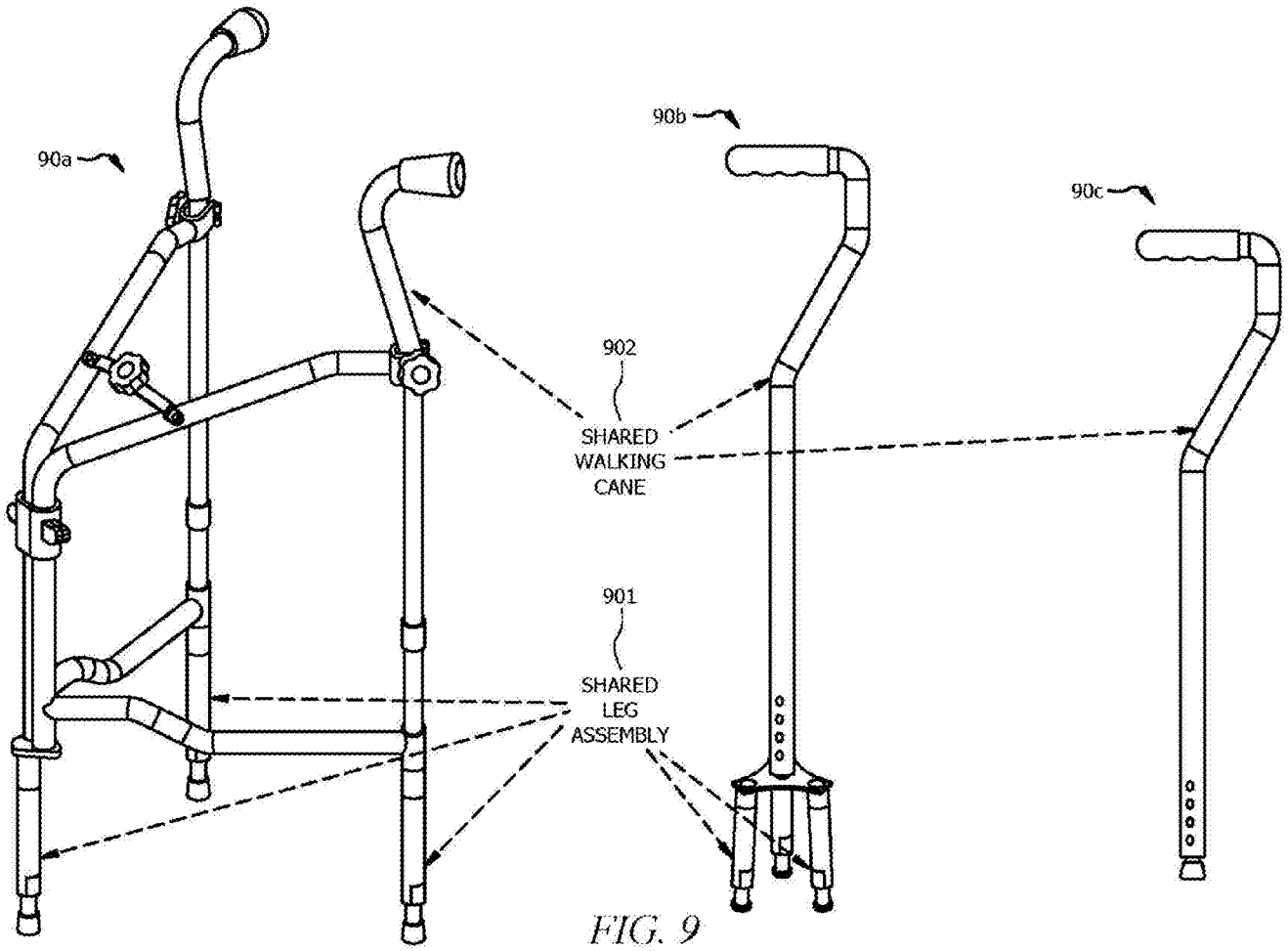
FIG. 9 depicts different parts and subassemblies that may be shared between an independently adjusting multi-legged walker/cane assembly, an independently adjusting multi-legged cane and a single-pointed cane according to an embodiment of the present disclosure.

FIG. 9 depicts different parts and subassemblies that may be common between independently adjusting multi-legged walker/cane assembly 90*a*, independently adjusting multi-legged cane 90*b* and single-pointed cane 90*c* according to an embodiment of the present disclosure. More specifically, FIG. 9 depicts how walker/cane assembly 90*a* and multi-legged cane 90*b* may each include shared leg assembly 901 in some embodiments of the present disclosure. FIG. 9 further depicts how walker/cane assembly 90*a*, multi-legged cane 90*b* and single-pointed cane 90*c* may each include shared walking cane 902 in some embodiments of the present disclosure.

Figure 10A:
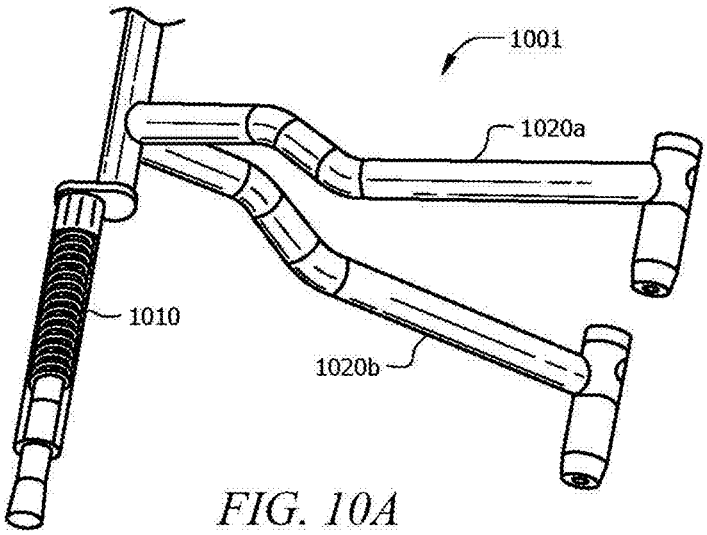
FIG. 10A depicts a spring-loaded leg as part of a walker/cane assembly according to an embodiment of the present disclosure.

FIG. 10A depicts spring-loaded leg 1010 formed as part of multi-legged frame 1001 according to an embodiment of the present disclosure. It should be appreciated that spring-loaded leg 1010 may include the same components operating in the same manner as described with respect to leg 70 in FIG. 7. In this embodiment of the present disclosure, legs are not depicted as attached to horizontal extender portions 1020*a*, 1020*b*. However, it should be appreciated that spring-loaded legs similar to spring-loaded leg 1010 may be affixed to horizontal extender portions 1020*a*, 1020*b* without departing from the present disclosure. In other embodiments of the present disclosure, horizontal extender portions 1020*a*, 1020*b* may include quick disconnects to each selectively and releasably receive a single-pointed cane having a spring-loaded leg portion.

Figure 10B:
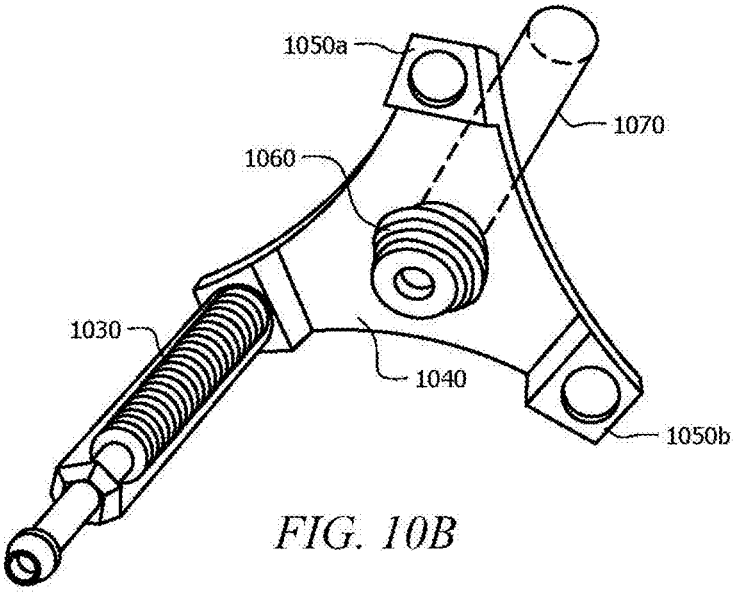
FIG. 10B depicts a spring-loaded leg as part of a multi-legged cane portion according to an embodiment of the present disclosure.

FIG. 10B depicts spring-loaded leg 1030 connected to base 1040 to form the lower portion of a multi-legged cane according to an embodiment of the present disclosure. As with FIG. 10A, it should be appreciated that spring-loaded leg 1030 may include the same components operating in the same manner as described with respect to leg 70 in FIG. 7. Base 1040 may include one or more openings 1050*a*, 1050*b* to selectively receive additional spring-loaded legs according to embodiments of the present disclosure. Base 1040 also may include opening 1060 to receive a portion of single-pointed cane 1070 according to an embodiment of the present disclosure.

Figure 11:
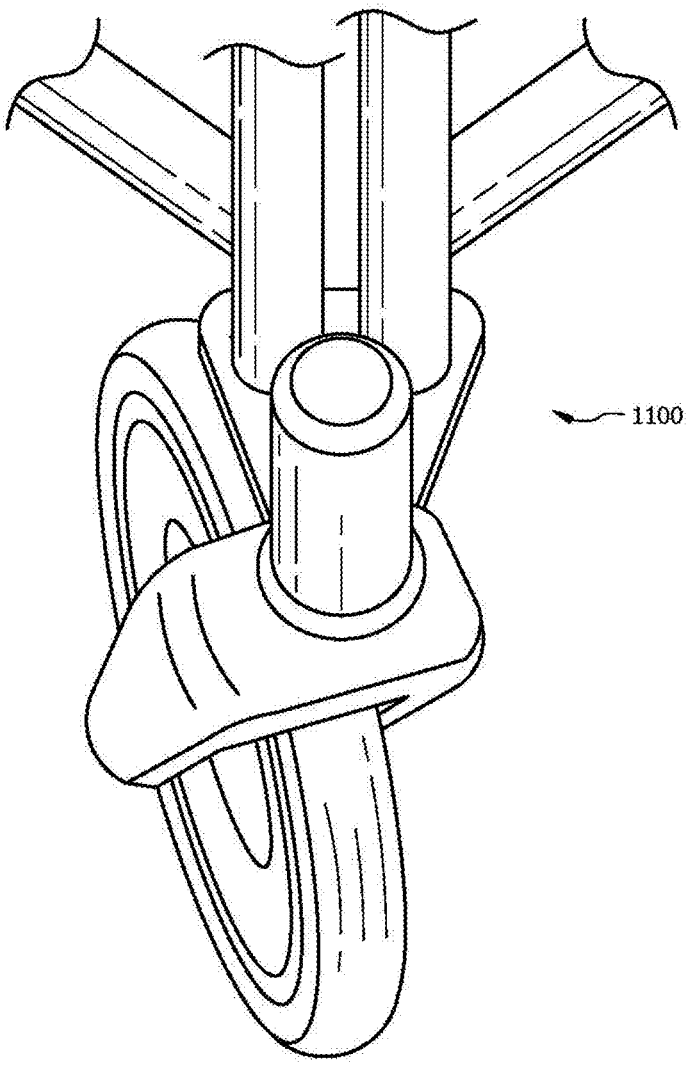
FIG. 11 depicts a wheel and roller support as part of a walker/cane assembly according to an embodiment of the present disclosure.
Figure 12:
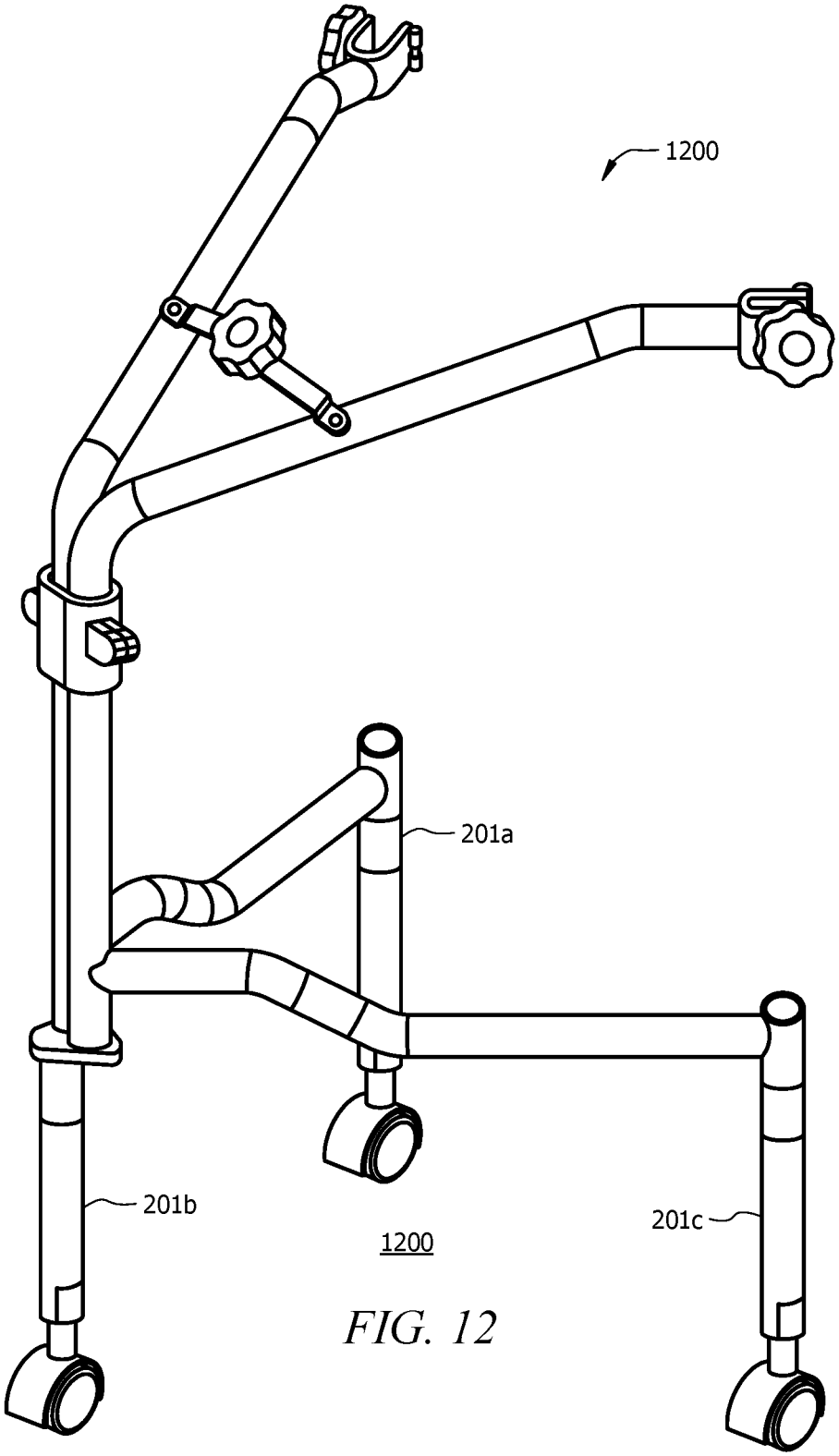
FIG. 12 depicts a multi-legged frame that may be used to form a walker/cane assembly according to an embodiment of the present disclosure.

FIG. 11 depicts wheel and roller support 1100 that may be included as part of a walker/cane assembly according to an embodiment of the present disclosure. Wheel and roller support 1100 may serve as an additional support for a walker/cane assembly according to embodiments of the present disclosure. By lifting the handles of the walker/cane assembly and pushing the assembly forward as the wheel and roller support 1100 rolls or slides, the user may move the assembly. This additional support may facilitate moving the walker/cane assembly without requiring the user to fully lift the entire assembly when moving in a forward direction. It should be appreciated that wheel and roller support 1100 may be permanently or releasably attached to a center support of the frame forming a walker/cane assembly according to embodiments of the present disclosure. For example, wheel and roller support 1100 may be connected to vertical support 202 (FIG. 1) in place of leg 201*b* in an embodiment of the present disclosure. FIG. 12 depicts multi-legged frame 1200 that may be used to form a walker/cane assembly according to an embodiment of the present disclosure. Multi-legged frame 1200 of FIG. 12 is similar to that depicted in FIG. 2 except that legs 201*a*, 201*b*, 201*c* each include a wheel and roller support that may contact with the ground. This may transform the walker/cane assembly into a shock-absorbing rolling walker/cane assembly that may maintain constant contact with the ground according to an embodiment of the present disclosure.

Figure 14A:
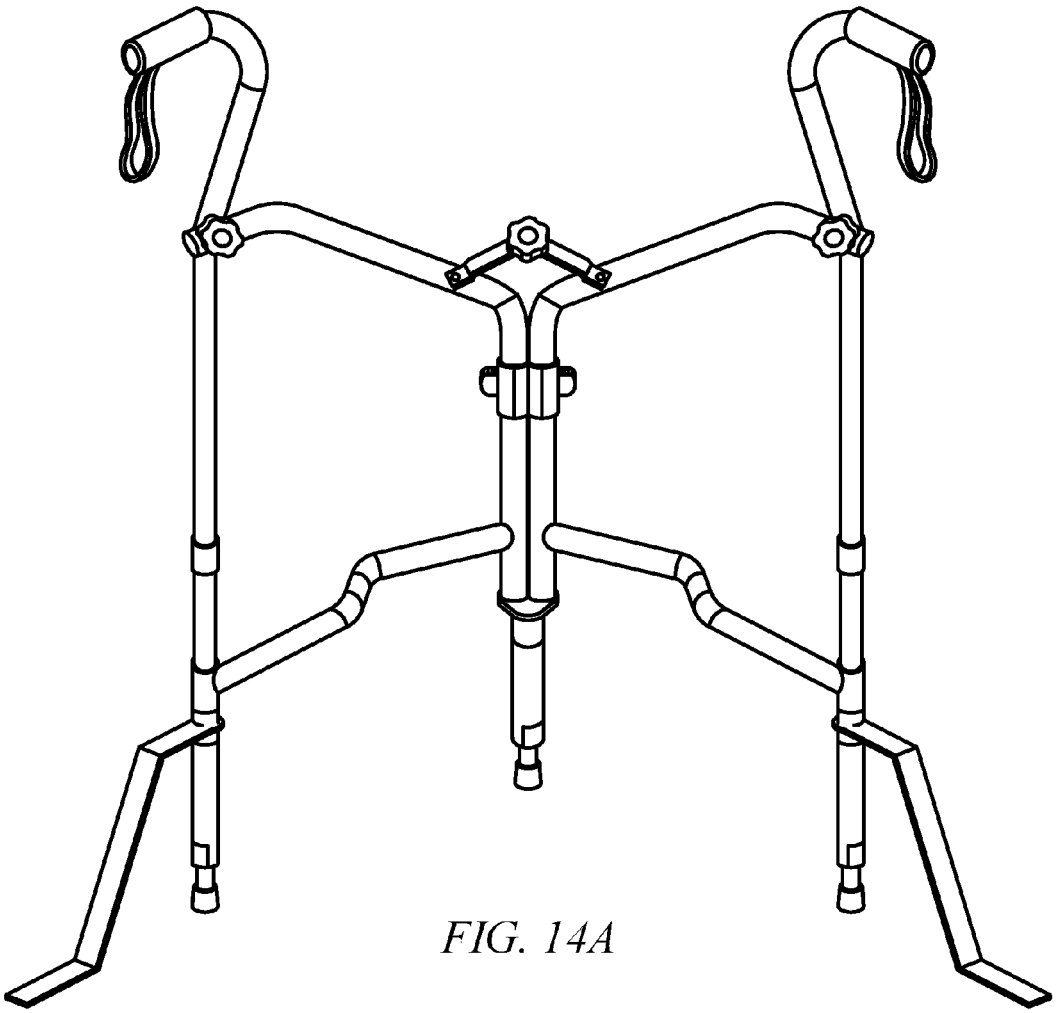
FIG. 14A depicts a walker/cane assembly having an extended foot support according to an embodiment of the present disclosure.
Figure 14B:
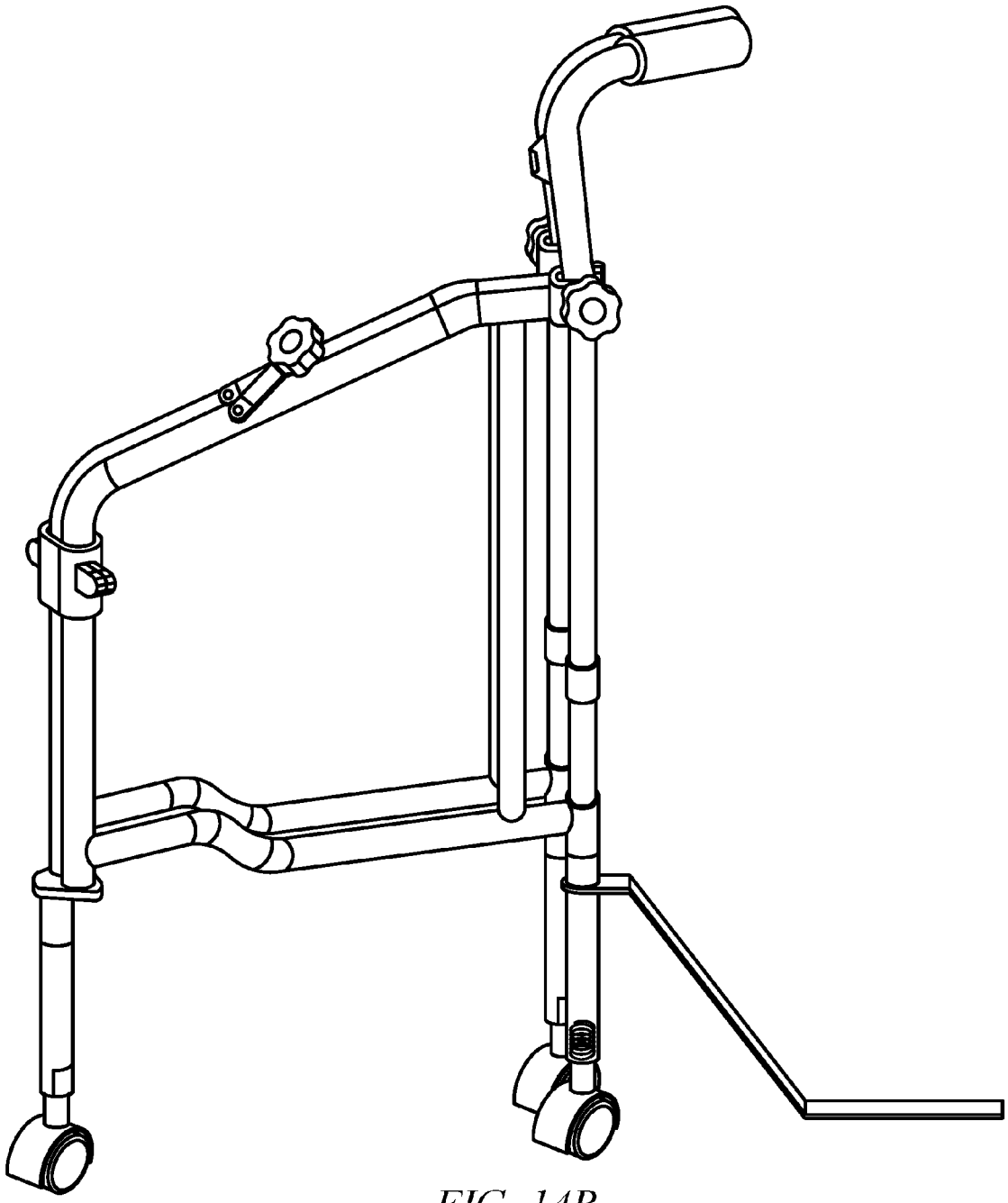
FIG. 14B depicts the walker/cane assembly of FIG. 13 including an extended foot support according to an embodiment of the present disclosure.

FIG. 14A depicts a walker/cane assembly according to an embodiment of the present disclosure, the assembly having an extended foot support, wherein the extended foot support acts as a stabilizer to maintain the walker/cane assembly in an upright position. FIG. 14B depicts the walker/cane assembly of FIG. 13 including an extended foot support according to an embodiment of the present disclosure. In an embodiment of the present disclosure, the extended foot support may be approximately ½inch above the roller when there is no load present. When the user applies partial body weight, such as to change from a sitting position to a standing position, the spring may compress which may cause the roller to move upward and the roller will not anymore because the extended foot support would then contact the floor. This may aid the walker/cane assembly in not sliding. In some embodiments of the present disclosure, the extended foot support may include two feet that may work as a stabilizer to support the weight of a user so that he/she may stand up from a seated position. The extended foot support also may prevent the walker/cane assembly from a tip-over or roll-over accident. In additional embodiments of the present disclosure, the extended foot support may work as a safety device when the user is in a standing position. It should be appreciated that the user may use the walker/cane assembly to support himself/herself when the user becomes unstable. When the user puts his/her partial body weight on the walker/cane assembly, the spring may compress so that the roller may no longer roll. It also should be appreciated that an anti-sliding material may be applied to the surface of an extended foot support so as to provide an additional safety feature during use of the walker/cane assembly according to an embodiment of the present disclosure.

Figure 15A:
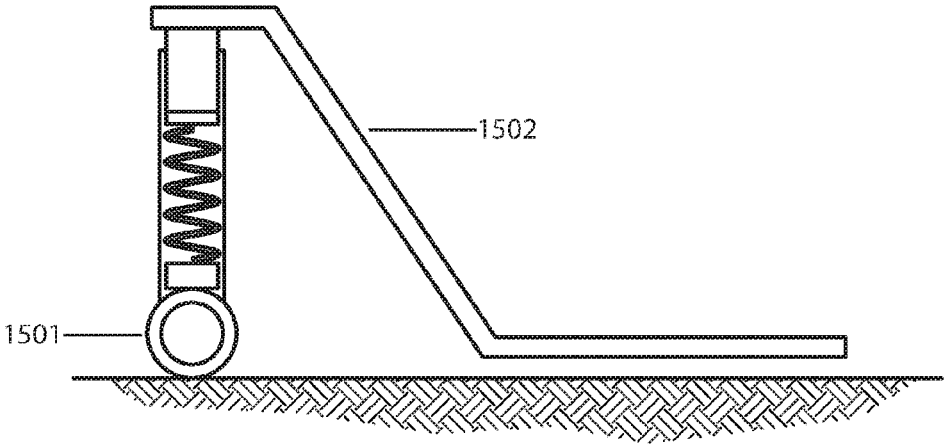
FIGS. 15A and 15B depict use of an extended foot support in a walker/cane assembly according to an embodiment of the present disclosure.
Figure 15B:
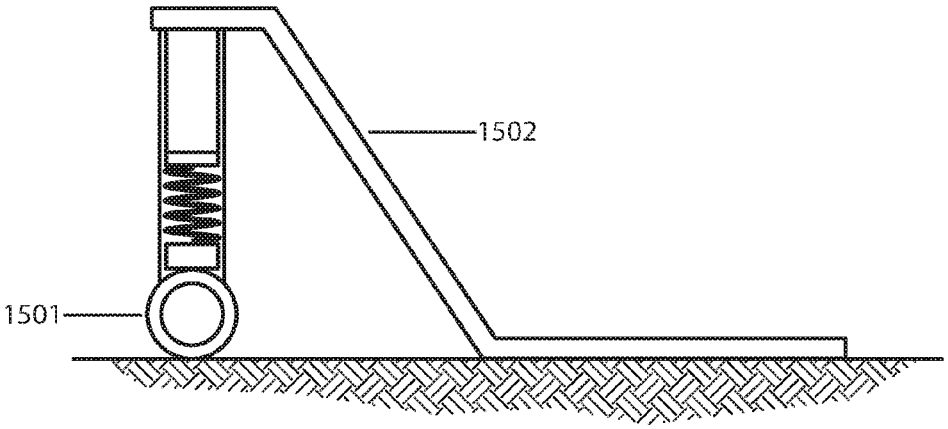

FIGS. 15A and 15B depict use of an extended foot support in a walker/cane assembly according to an embodiment of the present disclosure. More specifically, FIG. 15A depicts a portion of a walker/cane assembly in a normal position where roller 1501 is contacting the ground and the extended foot support 1502 is not contacting the ground, while FIG. 15B depicts a portion of a walker/cane assembly under pressure. In FIG. 15B, it is depicted that the extended foot support 1502 contacts the ground when the walker/cane assembly is under pressure.

While several embodiments of a walker/cane assembly have been described as having three legs, it should be appreciated that the assembly may include four legs (or more or less legs) without departing from the present disclosure. Regardless the number of legs employed, it should be appreciated that each of the legs employed within a frame of a walker/cane assembly or a multi-legged cane should be independently adjusting, whereby each leg may operate independently of the other legs through a spring compression mechanism.

As previously discussed, positive constant contact of all legs of the walker/cane assembly may be attained by allowing each of the plurality of legs to independently adjust to variations in position of each foot/leg relative to the angle of the walker/cane assembly, the ground surface, including surface variations, and the position of the user. As the user applies downward pressure to the walker/cane assembly, the foot on the end of each leg may compress a spring, thereby allowing the foot of the leg to stay in constant contact with the ground, regardless of the angle or position of the walker/cane assembly at any given time. It should be appreciated that spring tension within each of the plurality of legs may be adjusted to compensate for the size of different users via a length adjustment on the springs and/or with interchange of springs in the plurality of legs according to embodiments of the present disclosure. Accordingly, a walker/cane assembly according to embodiments of the present disclosure may allow the user to navigate uneven terrain as the plurality of legs on the walker/cane assembly adjust to the ground surface during use.

The walker/cane assembly, multi-legged cane, and single-pointed cane may share common parts and subassemblies that may be easily connected and detached. This ease in converting the walker/cane assembly to a multi-legged cane and/or a single-pointed cane and vice versa may facilitate the rehabilitation process for a user. Using a walker/cane assembly according to embodiments of the present disclosure may allow a user to purchase a single assembly that may be quickly and easily modified to meet the user's needs, such as his/her current balance or energy level. Through the inclusion of quick disconnects to change the walker/cane assembly into a multi-legged or single-pointed cane, even a user who is weakened from surgery and the rehabilitation process may be able to convert from a walker to a cane and vice versa without much, if any, additional assistance.

In addition, the inclusion of quick disconnects and one or more folding mechanisms may allow the walker/cane assembly, or the frame forming a portion of the walker/cane assembly, to be easily collapsed and folded. This may allow a user to store the walker/cane assembly or the frame portion of the assembly in a smaller amount of space than the expanded walker/cane assembly or the frame portion of the assembly may otherwise occupy.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A walker/cane assembly comprising:

a frame having a plurality of independently adjustable and selectively detachable legs, each of the plurality of independently adjustable and selectively detachable legs having a tube section, a spring or tension element within the tube section between a plunger at a lower end of the tube section and an end stop at an upper end of the tube section, and a foot extending from a lower portion of the tube section, the foot having a roller, wherein as downward pressure is applied to the walker/cane assembly, the foot on the end of each leg compresses the spring or tension element within each leg, allowing the roller on foot to stay in constant contact with the ground, wherein at least one of the plurality of independently adjustable and selectively detachable legs is a multiple leg structure having a single base;

a pair of single-pointed canes attached to the frame via one or more quick disconnects, wherein, using the plurality of independently adjustable and selectively detachable legs and at least one of the pair of single-pointed canes of the walker/cane assembly, the walker/cane assembly is selectively convertible from a walker to a multilegged cane to a single-pointed cane; and an interchangeable base that receives one of the pair of single-pointed canes and at least one of the plurality of independently adjustable and selectively detachable legs detached from the walker/cane assembly, thereby transforming the walker/cane assembly into a multi-legged cane.

2. The walker/cane assembly of claim 1 further comprising:

a folding mechanism on the frame to selectively expand and collapse the walker/cane assembly when not in use.

3. The walker/cane assembly of claim 1 wherein the walker/cane assembly is converted from a walker to a single-pointed cane through release of the one or more quick disconnects.

4. The walker/cane assembly of claim 1 wherein at least two of the plurality of independently adjustable and selectively detachable legs include openings on an upper end to receive at least a portion of the pair of single-pointed canes.

5. The walker/cane assembly of claim 1 wherein the pair of single-pointed canes provide quick height adjustment functionality.

6. The walker/cane assembly of claim 4 wherein the pair of single-pointed canes lock into place within the openings via detents.

7. The walker/cane assembly of claim 1 wherein the plurality of independently adjustable and selectively detachable legs comprises three independently adjustable and tensioned legs positioned in a triangular arrangement wherein a first leg forms the central support for the frame and the second leg and the third leg are positioned at approximately 45-degree angles relative to the first leg.

8. The walker/cane assembly of claim 7 wherein the second leg and the third leg extend from a vertical portion of the frame located above the first leg via horizontal extender portions.

9. The walker/cane assembly of claim 8 wherein the horizontal extender portions remain positioned at 45-degree angles relative to the vertical portion when the frame is in an extended state.

10. The walker/cane assembly of claim 8 wherein the first leg is integrally formed with the vertical portion.

11. The walker/cane assembly of claim 8 wherein the first leg is detachably connected to the vertical portion.

12. The walker/cane assembly of claim 8 wherein at least one of the horizontal extender portions includes the one or more quick disconnects to selectively receive one of the pair of single-pointed canes.

13. The walker/cane assembly of claim 1 further comprising:

an extended foot support, wherein the extended foot support acts as a stabilizer to maintain the walker/cane assembly in an upright position.

14. A walker/cane assembly comprising:

a frame having a plurality of independently adjustable and selectively detachable legs, each of the plurality of independently adjustable and selectively detachable legs having a tube section with a slot, a spring or tension element within the tube section between a lower end of the tube section and an end stop at an upper end of the tube section, and a foot extending from a lower portion of the tube section, wherein as downward pressure is applied to the walker/cane assembly, the foot on the end of each leg compresses the spring or tension element within each leg, wherein at least one of the plurality of independently adjustable and selectively detachable legs is a multiple leg structure having a single base;

a pair of single-pointed canes attached to the frame via one or more quick disconnects, wherein, using the plurality of independently adjustable and selectively detachable legs and at least one of the pair of single-pointed canes of the walker/cane assembly, the walker/cane assembly is selectively convertible from a walker to a multilegged cane to a single-pointed cane; and an interchangeable base that receives one of the pair of single-pointed canes and at least one of the plurality of independently adjustable and selectively detachable legs detached from the walker/cane assembly, thereby transforming the walker/cane assembly into a multilegged cane.

15. The walker/cane assembly of claim 14 wherein the end stop pushes against a detent button to maintain the spring or tension element in position.

16. The walker/cane assembly of claim 15 wherein the slot in the tube section allows the detent button to latch the tube section.

17. The walker/cane assembly of claim 14 wherein one of the plurality of independently adjustable and selectively detachable legs is a quick disconnect shock absorbing leg.

18. The walker/cane assembly of claim 17 wherein the quick disconnect shock absorbing leg is connected to one of the pair of single-pointed canes to convert to a spring-loaded shock absorbing cane.

19. The walker/cane assembly of claim 17 wherein the quick disconnect shock absorbing leg is attached using an adaptor, wherein an upper end of the adaptor is attached to the frame and a bottom end of the adaptor contains a detent button to receive the quick disconnect shock absorbing leg.

* * * * *